United States Patent [19]

Romanos

[11] 4,220,199

[45] Sep. 2, 1980

[54] PLATE TUBE SPACER STRUCTURE

[75] Inventor: Nicholas D. Romanos, Chattanooga, Tenn.

[73] Assignee: Combustion Engineering, Inc., Windsor, Conn.

[21] Appl. No.: 56

[22] Filed: Jan. 2, 1979

[51] Int. Cl.[2] ..... F28F 19/00; F28F 9/00

[52] U.S. Cl. ..... 165/134 R; 122/510; 122/DIG. 13; 165/162; 165/172

[58] Field of Search ..... 165/162, 172, 134 R; 122/510, DIG. 13

[56] References Cited

U.S. PATENT DOCUMENTS

| | | | |
|---|---|---|---|
| 2,980,404 | 4/1961 | Andersen et al. | 165/172 |
| 3,292,691 | 12/1966 | Welter et al. | 165/172 |
| 3,434,531 | 3/1969 | Hochmuth et al. | 165/162 |
| 3,503,440 | 3/1970 | Romanos | 165/162 |
| 3,575,236 | 4/1971 | Romanos | 165/162 |
| 3,854,529 | 12/1974 | Sagan | 165/162 |
| 3,998,268 | 12/1976 | Sagan | 165/172 |

FOREIGN PATENT DOCUMENTS

| | | | |
|---|---|---|---|
| 950727 | 2/1964 | United Kingdom | 165/162 |

*Primary Examiner*—Sheldon Richter
*Attorney, Agent, or Firm*—Arthur E. Fournier, Jr.

[57] ABSTRACT

A plate tube spacer structure operable for concomitantly effecting both the spacing and the supporting of the individual tubes of a tube bundle, the latter commonly constituting one of the components of a conventionally constructed heat exchanger. The subject plate tube spacer structure includes a plurality of elongated plates that are suitably disposed in stacked, spaced relation so as to allow for a layer of tubes to be interposed between each pair of adjacent plates. The plates each have a multiplicity of tube engaging means formed along each longitudinally extending side edge thereof. The multiplicity of tube engaging means are suitably disposed so as to effectively provide each plate with two parallel rows thereof. The arrangement of the rows of tube engaging means of each plate is such that the multiplicity of tube engaging means of one row thereof are aligned with, but face in a direction opposite to that of the multiplicity of tube engaging means of the other row thereof. All of the multiplicity of tube engaging means of a given plate project outwardly in a common direction away from the plane of the plate, and are each suitably configured so that a tube may be tangentially engaged therewith in supported relation thereto. Also, the multiplicity of tube engaging means are each further provided with means operable for discouraging the buildup at the interface between a tube and the tube engaging means of deposits that could have a detrimental effect on the tube. To provide the subject plate tube spacer structure with added strength, preferably at least some of the multiplicity of tube engaging means of each plate are suitably secured to a corresponding number of tube engaging means of an adjacent plate.

10 Claims, 3 Drawing Figures

PLATE TUBE SPACER STRUCTURE

BACKGROUND OF THE INVENTION

This invention relates to heat exchangers, and more particularly to a tube spacer and support structure of the type that is operable for use in a heat exchanger to effect both the spacing and the support of the individual tubes of a tube bundle that is employed therein.

It has long been known in the prior art to utilize some form of means for purposes of accomplishing the spacing and/or the support of tubes in a heat exchanger. By definition, a heat exchanger is a device, which is operative to effect a heat transfer between two fluids without allowing the two fluids to mix. Commonly, this is accomplished by having one of the fluids flow through a multiplicity of tubes that are suitably arranged in the heat exchanger so as to lie in the path of flow of the other fluid, as the latter flows through the heat exchanger. For purposes of this discussion, the fluid flowing through the tubes is referred to as the primary fluid and the fluid flowing past the tubes as the secondary fluid. It is to be understood that the term fluid as it is being used herein is intended to encompass both liquids and gases. Thus, the primary and secondary fluids may be both gases or both liquids, or the primary fluid may be a gas and the secondary fluid a liquid, or vice versa.

For purposes of effectively and efficiently accomplishing the desired transfer of heat between the primary fluid and the secondary fluid, it is important that there be provided the proper amount of space between individual tubes in order to allow for the passage of the secondary fluid therebetween. In addition, it is also important that the tubes be properly oriented relative to the flow path of the primary fluid through the heat exchanger in order to insure that the maximum amount of tube surface area is made available to be engaged by the primary fluid as the latter flows thereby.

Further, as noted above, it is also important that attention be directed to the manner in which the tubes, through which the secondary fluid flows, are supported in the heat exchanger. For example, the tubes must be supported in such a manner as to insure, to the extent possible, that the tubes do not fail for lack of support, and thereby as a consequence of such failure effect an intermixing of the primary fluid and the secondary fluid. This is particularly true in the case of those applications wherein the subject heat exchanger constitutes one of the components of a nuclear reactor system, and wherein the subject heat exchanger is operative therein to effect a heat transfer between a contaminated fluid and an uncontaminated fluid. Obviously, under such circumstances it is important that an intermixing of the two fluids be prevented so that the uncontaminated fluid does not become contaminated by the contaminated fluid, as a result of tubes having become damaged and/or because of tube failure.

One potential cause of such tube damage and/or tube failure to which the prior art has directed its attention is that of vibrations. Unless steps are taken to provide the tubes of the heat exchanger with adequate support, flow-induced vibrations or other mechanically induced vibrations are known to be capable of causing tube damage. However, there do exist in the prior art plate tube spacer structures, which have been found to be operative to prevent tube damage caused by flow-induced or other mechanically induced vibrations. By way of illustration, reference may be had in this regard to U.S. Pat. Nos. 3,503,440 and 3,575,236 for a teaching of such prior art forms of plate tube spacer structures. Both of the aforereferenced patents issued in the name of the same inventor, who is also the inventor of the subject matter of the instant application, and have been assigned to the same assignee as the present application.

In accordance with the teachings of U.S. Pat. No. 3,503,440—Romanos, a plate member is disclosed having mutually spaced projections formed along both side edges thereof. The projections are offset in a direction normal to the plane of the plate member so as to define U-shaped, tube-engaging receptacles that are adapted to retain tubes therein. U.S. Pat. No. 3,575,236—Romanos on the other hand is directed to a plate member wherein struck out tab projections, which extend normal from the plate, are arranged to engage the tubes at opposite, longitudinally-spaced points that are displaced by 90° from the points of plate engagement. Still another form of heat exchanger tube support comprises the subject matter of U.S. Pat. No. 3,998,268—Sagan. More specifically, the latter patent is directed to a structure wherein there is provided a plurality of support bars having two sets of arms that are generally normal to the support bars and extend outwardly from one side thereof, and a plurality of locking bars that are cooperatively associated with the plurality of support bars so as to be slidably disposed generally parallel to the support bars.

Mention has previously been made hereinabove of the fact that it is important that no intermixing of the primary fluid and secondary fluid be allowed to take place particularly when the heat exchanger is being employed as an operative part of the cooling system of a nuclear reactor. To this end, stringent regulations have been promulgated regarding the amount of stress that the tubes of the heat exchangers must be capable of bearing before damage occurs thereto in such applications. The determination of such stress levels is normally predicated upon the occurrence of some hypothetical failure, which produces an abnormal stress loading condition on the tubes. Accordingly, the tubes in the heat exchanger must thus be provided with sufficient support so as to enable them to not only withstand the stress levels to which they are subjected under normal operating conditions, but also must be suitably supported so as to be capable of withstanding specified stress levels when the heat exchanger is in a failure mode.

Apart from the factors referred to hereinabove, which may be the cause of tube failure in a heat exchanger, there is another factor that has gained prominence more recently as a potential cause of damage to the tubes of a heat exchanger. Reference is had here to the matter of deposit buildup on the tubes. Although it has long been a well-known practice in the prior art to attempt to reduce the likelihood of the occurrence of such deposit buildup by implementing procedures having as their goal the elimination of the occurrence in the fluids of such deposit-forming elements, such procedures are not only relatively expensive to employ, but also have not proven to be a complete solution to the problem. Generally speaking, the damage done to the tubes resulting from the accumulation of such buildups of deposits commonly takes two forms. Namely, in some cases the extent of the deposit buildup is so great that excessive pressure is made to bear on the tubes. In such cases, the result is that deformation of the tubes occurs. Depending on the extent of the deformation, the tube may remain undamaged, or the tubes may develop a leak, or total failure of the tube may occur. The other major form of damage, which tubes have been known to suffer from the buildup of deposits thereon, apparently stems from the occurrence of some type of electro-chemical reaction between the deposit material, the material of the support structure and the tube material. Depending on the severity of the reaction, here also the tubes may be undamaged, or the tubes may be damaged to the extent that a leak occurs therein, or there may be a total failure of the tube.

It should now be apparent from the above discussion that there are a number of requirements that a plate tube spacer structure must meet if it is to successfully achieve its intended function in an effective and efficient manner when employed in a heat exchanger. Namely, the subject plate tube spacer structure must be operative to properly space the tubes one from another, and to insure that the tubes are properly oriented relative to the path of flow of the secondary fluid through the heat exchanger. Moreover, the subject plate tube spacer structure must be operative to provide the required support to the tubes in order to insure that the tubes are capable of withstanding specified stress levels without incurring damage thereto, while at the same time insuring that provision is made to enable thermal expansion of the parts to take place. The latter is particularly important because of the fact that the various components such as the plate tube spacer structure, the tubes, etc. are made of different materials, each having different rates of thermal expansion, and the fact that the thermal expansion may occur in multiple directions. Cognizance must, therefore, be taken of all of these considerations relating to the matter of thermal expansion in providing a plate tube spacer structure that is intended for use in a heat exchanger. Finally, the subject plate tube spacer structure should be operative to discourage the buildup of deposits on the plate tube spacer structure and/or the tubes being spaced and supported thereby, because of the attendant possibility of damage to the tubes that could occur as a consequence thereof. Although a multiplicity of heat exchanger tube support means embodying a variety of different configurations have been previously known to exist in the prior art, nevertheless there has still been shown to exist in the prior art a need for a new and improved plate tube spacer structure, which would be capable of meeting all of the requirements, as recited above, that should characteristically be fulfilled by such a device.

OBJECTS OF THE INVENTION

It is therefore an object of the present invention to provide a novel and improved plate tube spacer structure that is suitable to being employed in cooperative association with the tubes of a heat exchanger.

It is another object of the present invention to provide such a plate tube spacer structure that is suitable for use in a heat exchanger of the type that comprises one of the components of the cooling system of a nuclear power generation system.

It is still another object of the present invention to provide such a plate tube spacer structure that is operative to effect the proper spacing of the tubes of a heat exchanger so as to allow for the flow of fluid therebetween.

A further object of the present invention is to provide such a plate tube spacer structure, which is operative to effect the proper orientation of the tubes of the heat exchanger so as to insure that the maximum amount of tube surface area is exposed for contact by the uncontaminated fluid flowing through the heat exchanger.

A still further object of the present invention is to provide such a plate tube spacer structure that is operable to effect the support of the tubes of the heat exchanger.

Yet another object of the present invention is to provide such a plate tube spacer structure that is operable to effect the support of the tubes of a heat exchanger, while at the same time permitting thermal expansion of the component parts of the heat exchanger to take place.

Yet still another object of the present invention is to provide such a plate tube spacer structure that operates to discourage the buildup of deposits, which could produce tube damage.

Yet a further object of the present invention is to provide such a plate tube spacer structure that is characterized by the fact that it is relatively economical to manufacture, as well as being relatively easy to assemble and employ.

SUMMARY OF THE INVENTION

In accordance with a preferred form of the invention, there is provided a novel and improved plate tube spacer structure that is suitable for use for the purpose of concomitantly effecting the spacing and the support of the individual tubes, which taken collectively comprise the tube bundle of the type that is commonly to be found being employed in a heat exchanger of conventional construction as one of the components thereof. This spacing and supporting of the tubes is effected for a dual purpose; namely, for the purpose of preventing the tubes from being damaged by vibrations that are flow induced or mechanically induced by some other cause, and for the purpose of minimizing the occurrence of tube failure occasioned by the buildup of deposits thereon. The subject plate tube spacer structure includes a plurality of elongated plates that are suitably disposed so as to allow for a layer of tubes to be interposed between each pair of adjacent plates. The plates each have a multiplicity of fingers formed along each longitudinally extending side edge thereof. The multiplicity of fingers are disposed so as to effectively provide each plate with two parallel rows thereof. The arrangement of the rows of fingers of each plate is such that the multiplicity of fingers of one row thereof are aligned with but face in a direction opposite to that of the multiplicity of fingers of the other row thereof. All of the multiplicity of fingers of a given plate project outwardly in a common direction away from the plane of the plate, and are each provided with a curved configuration so that a tube may be tangentially engaged therewith in supported relation thereto. Also, the multiplicity of fingers are each further provided with means, in the form of an elongated slot extending longitudinally substantially the entire length of the finger, that functions to discourage the buildup at the interface of a tube and the finger of deposits that could have a detrimental effect on the tube. To provide the subject plate tube spacer structure with additional strength, preferably at least some of the multiplicity of fingers of each plate have their free end suitably welded to a corresponding number of fingers of an adjacent plate whereby there is produced a honeycomb-like structure.

DESCRIPTION OF A PREFERRED EMBODIMENT

Figure 1:
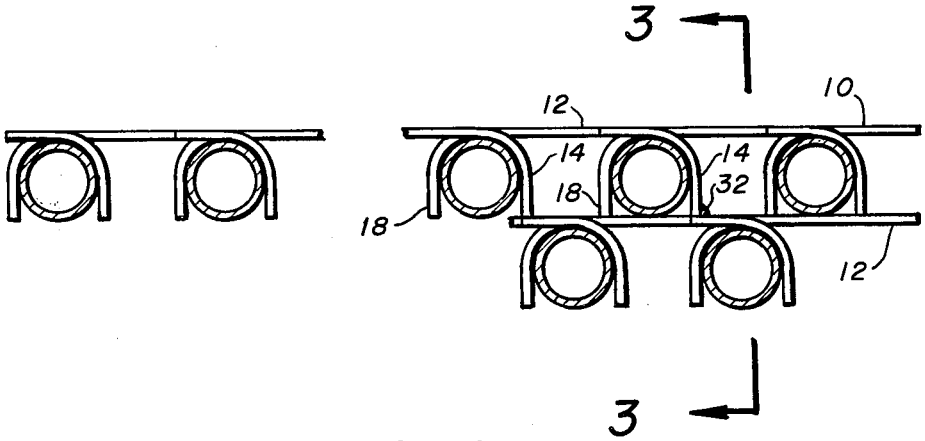
FIG. 1 is a side elevational view of a portion of a plate tube spacer structure constructed in accordance with the present invention.

Referring now to the drawing, and more particularly to FIG. 1 thereof, there is depicted therein a portion of a plate tube spacer structure, generally designated by reference numeral 10, constructed in accordance with the present invention. In the interest of maintaining clarity of illustration in the drawing and since the elongated plates 12, which collectively cooperate with one another in a manner yet to be described to comprise the plate tube spacer structure 10, are all identical in construction, it has been deemed sufficient for purposes of obtaining an understanding of the present invention to simply illustrate in the drawing two of the elongated plates 12 of the plate tube spacer structure 10. However, it is to be understood that although not shown in the drawing, the plate tube spacer structure 10 normally would include a plurality of such elongated plates 12. More specifically, in accordance with the preferred embodiment of the present invention the number of elongated plates 12 that are to be found embodied in the plate tube spacer structure 10 correspond in number, generally speaking, at least to the number of layers of tubes, which when considered collectively comprise the tube bundle of the heat exchanger in which the plate tube spacer structure 10 is to be employed.

Furthermore, inasmuch as the present invention is directed principally to the nature of the construction of the plate tube spacer structure 10 and is only indirectly related to the nature of the construction of the heat exchanger and/or the tube bundle thereof with which the plate tube spacer structure 10 is intended to be cooperatively associated, it has not been deemed necessary for purposes of providing one with an understanding of the present invention, to either illustrate in the drawing of the instant application or to provide a written description in the specification of the instant application, of the nature of the construction of such a heat exchanger and/or tube bundle. Rather, it is deemed sufficient to merely take cognizance of the fact that heat exchangers and/or tube bundles of the type with which the plate tube spacer structure 10 of the present invention is intended to be employed are well-known in the prior art. By way of exemplification in this regard, reference may be had for a teaching of a prior art form of such a heat exchanger and/or tube bundle to U.S. Pat. No. 3,503,440—Romanos or U.S. Pat. No. 3,575,236—Romanos.

As noted previously hereinabove, all of the elongated plates 12 of the plate tube spacer structure 10 are of identical construction. Consequently, a description of only one such elongated plate 12 will be set forth hereinafter. In this regard, reference will be had particularly to FIGS. 1 and 2 of the drawing for a teaching of the nature of construction of an elongated plate 12. As depicted in the latter figures, the elongated plate 12 consists of a relatively thin, metallic member that is relatively narrow in width, and which is of extended length.

The elongated plate 12 is provided with a multiplicity of tube engaging means, each generally designated by the reference numeral 14. The multiplicity of tube engaging means 14 includes a plurality of fingers 16 that are formed along each of the longitudinally extending side edges of the elongated plate 12. As best understood with reference to FIG. 2 of the drawing, the fingers 16 are suitably arranged along the longitudinally extending side edges of the elongated plate 12 so as to form a pair of parallel rows thereof, i.e., a first row and a second row of fingers 16. The number of fingers 16 per row thereof with which each elongated plate 12 is provided corresponds at least in number to the number of tubes that need to be spaced and supported by that particular elongated plate 12.

Figure 2:
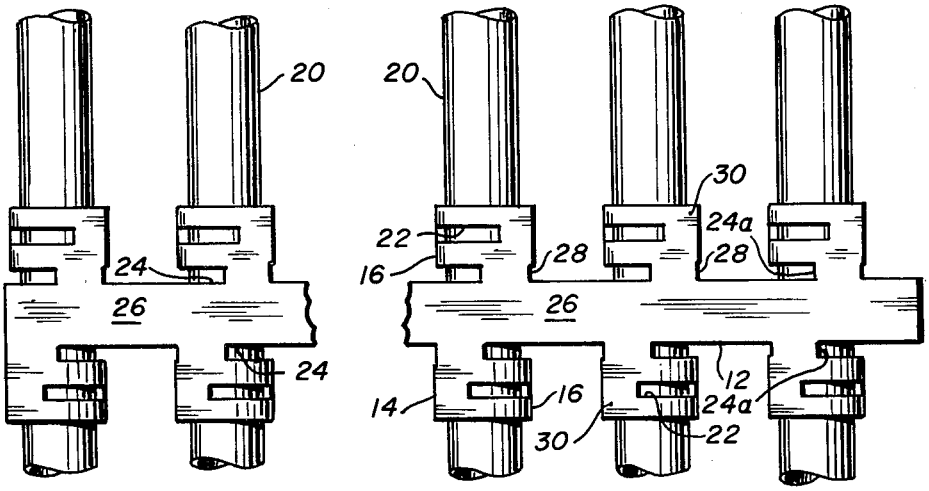
FIG. 2 is a plan view of one of the elongated plates of a plate tube spacer structure constructed in accordance with the present invention.

With further reference to FIG. 2 of the drawing, it can be seen therefrom that the fingers 16 are arranged in two parallel rows whereby each of the fingers 16 is aligned relative to another finger 16 in a transverse direction as viewed with reference to the longitudinal axis of the elongated plate 12. However, the fingers 16 that comprise the first row thereof are suitably arranged so as to all face in a common direction whereas all of the fingers 16 that comprise the second row thereof although they also all face in a common direction, the direction in which the second row of fingers 16 face is opposite to the common direction in which the first row of fingers 16 face. More specifically, the common direction to which reference is had here is that direction defined as the direction in which the free end 18 of each succeeding finger 16 of a given row thereof points. Thus, note is taken her of the fact that the direction in which the fingers 16 of the first row thereof face is approximately 180° from the direction in which the fingers 16 of the second row thereof face. Note should also be taken of the fact that the fingers 16 all project outwardly in the same direction away from the plane defined by the longitudinal axis of the elongated plate 12.

Continuing with a description of the nature of the construction of the elongated plate 12, as shown in FIG. 1 of the drawing each of the fingers 16 has a curved configuration. More specifically, the extent of the curvature of the fingers 16 is such as to be complementary to the curvature of the tubes 20 whereby the tubes 20 are capable of being supported relative to the fingers 16 in such a manner as to have a portion thereof which is tangentially engaged therewith. Namely, each pair of oppositely facing, but tangentially aligned fingers 16 is operative to perform the dual functions of providing support and suitable spacing for an individual one of the tubes 20.

Each of the fingers 16 is also provided with an elongated slot 22 running substantially the length thereof. The slot 22 formed in each of the fingers 16 is preferably located therein so as to be substantially equidistant from the longitudinally extending side edges of the corresponding finger 16. The slots 22 function as a means to discourage the buildup of deposits between the fingers 16 and the tubes 20 supported in tangential engagement therewith. Namely, the slots 22 are operative to reduce the amount of surface area in which contact takes place between the fingers 16 and the tubes 20 and concomitantly, therefore, the amount of surface area that is susceptible to being the recipient of deposit buildup. The effect thus is to encourage a minimization of deposit buildup at the interfaces between the fingers 16 and the tubes 20, and accordingly reduce the likelihood that the tubes 20 will incur damage, which could lead to tube leakage or ultimately to tube failure, as a consequence of the occurrence of such deposit buildup. As best understood with reference to FIGS. 1 and 2 of the drawing, the point of tangential engagement between the tube 20 and a corresponding pair of fingers 16 takes place at a point that lies substantially along an imaginary line suitably drawn so as to interconnect the end 24*a* of each of the respective slots 24, existing between a pair of fingers 16 that are tangentially aligned, but oppositely facing.

By way of reiteration, there are several ways in which the buildup of deposits may produce tube damage. Deposit buildup has been known to become so severe that the pressure being exerted thereby on a tube has been sufficient to produce deformation of a portion of the tube, thereby weakening the tube to a sufficient extent as to give rise to a tube leak and/or tube failure. In other instances, tube damage leading to tube leaks and/or tube failure has been traced to deposit buildup which has occasioned the occurrence with adverse results of what is thought to be some form of electrochemical reaction between the deposit material, the material of the tube plate spacer structure and/or the tube material.

Referring again to FIG. 2 of the drawing, as depicted therein the elongated plate 12 is further provided with a second series of slots, i.e., the slots designated 24 in FIG. 2. The latter slots 24 are suitably located between each one of the fingers 16 and an adjacent portion of the continuous strip 26 of material, which runs the entire length of the elongated plate 12, such that there is a slot 24 associated with each one of the fingers 16. In addition to facilitating, in a manner which will be more fully described hereinafter, the manufacturing operation whereby the fingers 16 are formed, the slots 24 also perform another important function; namely, the existence of the slots 24 serves to further reduce the amount of surface area on which deposit buildup can take place.

Turning now to a consideration of the method of manufacture of the elongated plate 12, the nature of the construction thereof is such that the elongated plate 12 lends itself to the realization of economies in the manufacture thereof. More specifically, as noted previously hereinabove, the elongated plate 12 consists of an elongated, relatively thin metallic member. Accordingly, a shearing process, which is a relatively inexpensive manufacturing process, is capable of being utilized for purposes of effecting the cutting out of the individual elongated plates 12 from strip material, i.e., flat pieces of stock. Thereafter, the elongated plates 12 can be subjected to one or more blanking operations, which are also known to be very economical to employ, for purposes of effecting the formation of the fingers 16 therein. Included in the formation of the fingers 16 is the establishment of the slots 24 between the fingers 16 and the continuous strip 26, the formation of the slot 22 in each one of the fingers 16, and the creation of the notches 28. The latter notches 28 are effected to facilitate the making of the transverse cut between longitudinally adjoining pairs of fingers 16 whereby the free end 18 of a finger 16 is established. It is important to note here that once again one of the primary functions of the plate tube spacer structure 10 and thus also of the elongated plates 12 is to effect the proper spacing between individual tubes 20. To this end, it is a requirement in the manufacture of the elongated plates 12 that tolerances be maintained so that the proper dimensioning of the fingers 16 is accomplished. Otherwise, improper dimensioning of the fingers 16 can give rise to the improper spacing of the tubes 20 with a concomitant adverse effect on the efficient operation of the heat exchanger in which the plate tube spacer structure 10 is designed to be employed.

In accordance with the preferred practice of the instant invention, the plate tube spacer structure 10, as noted above previously, consists of a plurality of elongated plates 12. More specifically, the elongated plates 12 of the plate tube spacer structure 10 are suitably arranged relative to each other so as to bear a stacked, spaced relationship to each other whereby a layer of tubes 20 can be interposed therebetween. In actual practice the method of assembly of the plate tube spacer structure 10 and more specifically, of the elongated plates 12, generally speaking, is as follows. A suitable number of the individual tubes 20 of the tube bundle of the heat exchanger are positioned in such a manner as to effect the establishment of a first layer thereof. There upon, an elongated plate 12 is brought into juxtaposed relation with the aforesaid first layer of tubes 20 so as to enable an individual tube 20 to be received in supported relation with one of the pairs of transversely, aligned, but oppositely facing fingers 16 such that there is tangential engagement between the individual tube 20 and a portion of each of the fingers 16 that comprise the aforesaid transversely aligned pair thereof. Once all of the individual tubes 20, which comprise the aforementioned first layer thereof have been assembled to the elongated plate 12 and more specifically, to a corresponding pair of transversely aligned, but oppositely facing fingers 16, in the manner described above, a second layer of tubes 20 is formed, whereupon the above-described procedure of assembling the individual tubes 20 of a layer thereof to corresponding pairs of fingers 16 of a second elongated plate 12 is repeated. In the interest of providing the plate tube spacer structure 10 with adequate strength to accomplish its supporting function relative to tubes 20, in accordance with the preferred embodiment of the invention, every fourth finger 16 of each of the elongated plates 12 to be found embodied in the plate tube spacer structure 10 preferably has the free end 18 thereof suitably affixed, such as by welding, to the fixed end 30 of the finger 16 of an adjoining elongated plate 12 that is in closest proximinity thereto. Reference may be had in this connection to FIG. 1 of the drawing wherein there is shown the existence of such a weld, designated therein by reference numeral 32, between the free end 18 of one of the fingers 16 of a first elongated plate 12 and the fixed end 30 of one of the fingers 16 of a second, adjoining elongated plate 12. The above process of assembling layers of tubes 20 to elongated plates 12 and effecting the interconnection of adjacent ones of the elongated plates 12 through the medium of welding the free ends 18 of a suitable number of fingers 16 to the fixed ends 30 of a corresponding number of fingers 16 is continued until such time as each layer of tubes 20 that taken collectively comprise the tube bundle of the heat exchanger has at least one elongated plate 12 assembled therewith. It should be noted here that although preferably every fourth finger 16 is welded to a corresponding finger 16 of another elongated plate 12, a greater or a lesser number of fingers 16 could be so welded without departing from the essence of the present invention. The particular number of fingers 16 that are selected to be welded one to another is a function of the amount of additional strength that needs to be imparted to the plate tube spacer structure 10.

Figure 3:
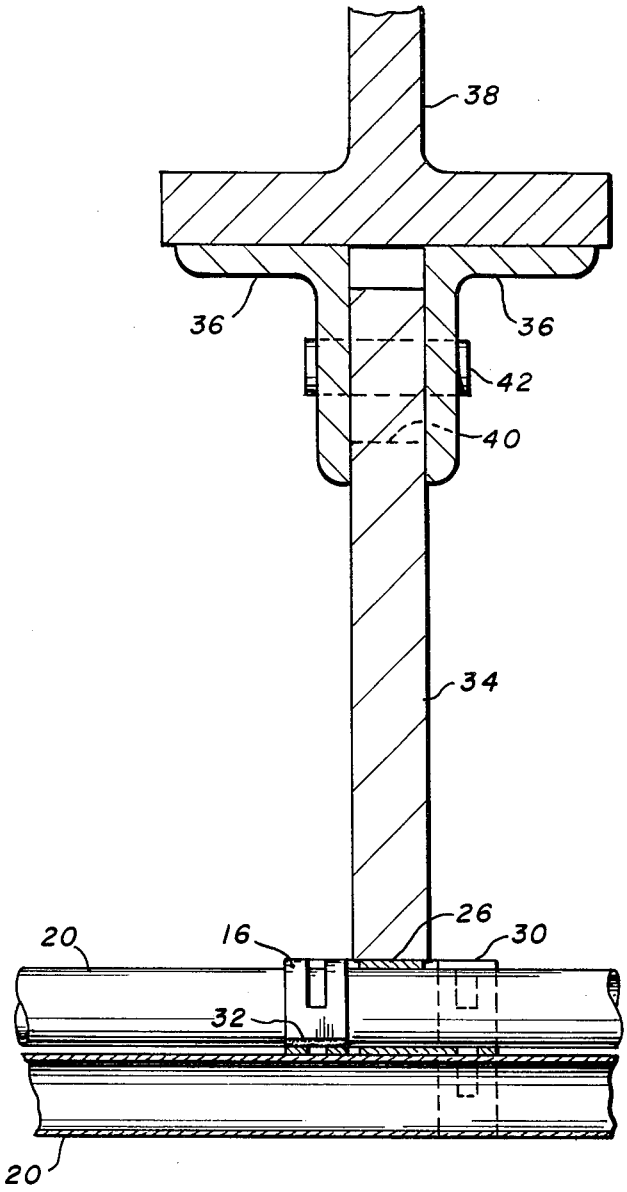
FIG. 3 is a cross-sectional view of a plate tube spacer structure constructed in accordance with the present invention taken substantially along the line 3—3 in FIG. 1 illustrated in association with mounting means for mounting the subject spacer structure in a heat exchanger.

For purposes of completing the description of the subject matter of the present invention, there will now be set forth one method that may be employed for purposes of effecting the installation of the plate tube spacer structure 10 of the present invention within a heat exchanger. Generally speaking, the plate tube spacer structure 10 of the present invention is intended to be mounted within a heat exchanger in a manner similar to that, which is to be found taught in U.S. Pat. No. 3,503,440—Romanos and U.S. Pat. No. 3,575,236—Romanos. To this end, with particular reference to FIG. 3 of the drawing of the instant application, the upper surface of the elongated plate 12 as viewed with reference to FIG. 2 is preferably fastened, such as by welding, to a plate-like member 34. The latter member 34 in turn extends between and is suitably mounted to a pair of clips 36, i.e., angle-like members, so as to be capable of movement relative thereto. Preferably, the interconnection of the member 34 to the clips 36 is accomplished by providing the member 34 with a suitably dimensioned slot 40 capable of receiving therewithin a pin 42 the ends of which are secured to the pair of clips 36. Finally, the clips 36 are preferably welded to the undersurface of an I-beam 38. The latter I-beam 38, it is to be understood, is suitably supported within the heat exchanger. The clips 36 and I-beam 38 correspond to similar components that are designated by the reference numerals 100 and 96, respectively, in U.S. Pat. No. 3,503,440—Romanos.

The above-described mounting means is preferably employed for purposes of effecting the installation of plate tube spacer structure 10 in a heat exchanger particularly in recognition of the fact that there exists a need to allow for thermal expansion of the components of the plate tube spacer structure 10 to take place. Namely, inasmuch as the elongated plates 12 and the tubes 20 spaced and supported thereby are made from different materials having different rates of thermal expansion, under normal operating conditions these components of dissimilar materials will expand at varying rates. Moreover, this thermal expansion will occur in multiple directions. Consequently, the support function provided by the plate tube spacer structure 10 must be accomplished in such a manner as to not inhibit the need for the various components to undergo thermal expansion. The aforedescribed suggested method of mounting the plate tube spacer structure 10 within the heat exchanger is capable of fulfilling the above requirement. Finally, note should be taken of the fact that the plate tube spacer structure 10 of the present invention is preferably utilized for purposes of accomplishing the desired spacing and support of the otherwise unsupported bight portion of tubes 20 that are substantially U-shaped in configuration and that have the ends thereof suitably secured to a tube sheet in the heat exchanger.

Thus, in accordance with the present invention there has been provided a novel and improved plate tube spacer structure that is suitable to being employed in cooperative association with the tubes of a heat exchanger. More specifically the subject plate tube spacer structure of the present invention is suitable for use in a heat exchanger of the type that comprises one of the components of the cooling system of a nuclear power generation system. In accordance with the present invention a plate tube spacer structure is provided that is operative to effect the proper spacing of the tubes of a heat exchanger so as to allow for the flow of fluid therebetween. Further, the subject plate tube spacer structure of the present invention is operative to effect the proper orientation of the tubes of the heat exchanger so as to insure that the maximum amount of tube surface area is exposed for contact by the uncontained fluid flowing through the heat exchanger. In accord with the present invention, there is also provided a plate tube spacer structure that is operable to effect the support of the tubes of a heat exchanger, while concomitantly permitting thermal expansion of the component parts of the heat exchanger to take place. Moreover, the subject plate tube spacer structure of the present invention is operative to discourage the buildup of deposits, which could produce tube damage. Finally, in accordance with the present invention a plate tube spacer structure has been provided that is characterized by the fact that it is relatively economical to manufacture while at the same time being relatively easy to assemble and employ.

While only one embodiment of my invention has been shown, it will be appreciated that modifications thereof, some of which have been alluded to hereinabove as for instance with reference to the number of fingers 16 that have the free end 18 thereof welded to another finger 16, etc., may readily be made thereto by those skilled in the art. I, therefore, intend by the appended claims to cover the modifications alluded to herein as well as all other modifications, which fall within the true spirit and scope of my invention.

What is claimed is:

1. An elongated plate operable for concomitantly effecting the spacing and the support of one layer of individual tubes of a tube bundle of a heat exchanger comprising a relatively thin, metallic member of relatively narrow width having a multiplicity of tube engaging means formed along each longitudinally extending side edge thereof; said multiplicity of tube engaging means being disposed so as to provide the elongated plate with two parallel rows thereof; said multiplicity of tube engaging means of one of said two parallel rows thereof being disposed so as to all face in the same direction; said multiplicity of tube engaging means of the other of said two parallel rows thereof being disposed so as to all face in the same direction, but in a direction opposite to that in which said multiplicity of tube engaging means of said one of said two parallel rows thereof face; said multiplicity of tube engaging means of both of said two parallel rows thereof all being disposed so as to project outwardly in a common direction away from the plane defined by the longitudinal axis of the elongated plate; said multiplicity of tube engaging means each having a configuration that is complementary to the configuration of the individual tubes to be received in spaced and supported relation thereto; and said multiplicity of tube engaging means each having formed therein means operative to discourage deposit buildup thereon and on the individual tubes received in tangential engagement therewith.

2. An elongated plate as defined in claim 1, wherein said multiplicity of tube engaging means comprises a multiplicity of fingers.

3. An elongated plate as defined in claim 2, wherein each of said multiplicity of fingers embodies a curved configuration.

4. An elongated plate as defined in claim 1, wherein said means operative to discourage deposit buildup comprises an elongated slot extending substantially the entire length of each of said multiplicity of tube engaging means, said slot being located substantially equidistant from the longitudinally extending side edges of each of said multiplicity of tube engaging means.

5. A plate tube spacer structure operable for concomitantly effecting both the spacing and the support of individual tubes of a tube bundle of a heat exchanger comprising at least one pair of elongated plates arranged in a stacked, spaced relation relative to each other so as to enable a layer of individual tubes to be interposed therebetween; each of said pair of elongated plates comprising a relatively thin, metallic member of relatively narrow width having a multiplicity of tube engaging means formed along each longitudinally extending side edge thereof; said multiplicity of tube engaging means being disposed so as to provide each of said pair of elongated plates with two parallel rows thereof; said multiplicity of tube engaging means of one of said two parallel rows thereof being disposed so as to all face in the same direction; said multiplicity of tube engaging means of the other of said two parallel rows thereof being disposed so as to all face in the same direction, but in a direction opposite to that in which said multiplicity of tube engaging means of said one of said two parallel rows thereof face; said multiplicity of tube engaging means of both of said two parallel rows thereof all being disposed so as to project outwardly in a common direction away from the plane defined by the longitudinal axis of the corresponding one of said pair of elongated plates in which said multiplicity of tube engaging means are formed; said multiplicity of tube engaging means each having a configuration that is complementary to the configuration of the individual tubes to be received in spaced and supported relation thereto; said multiplicity of tube engaging means each having formed therein means operative to discourage deposit buildup thereon and on the individual tubes received in tangential engagement therewith; and securing means operative to secure at least a number of said multiplicity of tube engaging means of one of said pair of elongated plates to a corresponding number of said multiplicity of tube engaging means to the other of said pair of elongated plates so as to provide increased strength to the plate tube spacer structure.

6. A plate tube spacer structure as defined in claim 5, wherein said multiplicity of tube engaging means comprises a multiplicity of fingers.

7. A plate tube spacer structure as defined in claim 6, wherein each of said multiplicity of fingers embodies a curved configuration.

8. A plate tube spacer structure as defined in claim 5, wherein said means operative to discourage deposit buildup comprises an elongated slot extending substantially the entire length of each of said multiplicity of tube engaging means, said slot being located substantially equidistant from the longitudinally extending side edges of each of said multiplicity of tube engaging means.

9. A plate tube spacer structure as defined in claim 5, wherein each of said pair of elongated plates includes a continuous strip of material extending the length thereof and defining the longitudinal axis thereof, said multiplicity of tube engaging means each being parallel to and having a portion thereof spaced from said continuous strip of material.

10. A plate tube spacer structure as defined in claim 5, wherein said securing means comprises welding means.

* * * * *

UNITED STATES PATENT AND TRADEMARK OFFICE

CERTIFICATE OF CORRECTION

PATENT NO. : 4,220,199

DATED : September 2, 1980

INVENTOR(S) : Nicholas D. Romanos

It is certified that error appears in the above—identified patent and that said Letters Patent is hereby corrected as shown below:

Column 12, line 11, change "to" to --of--.

Signed and Sealed this

*Eighteenth* Day of *November 1980*

[SEAL]

*Attest:*

SIDNEY A. DIAMOND

*Attesting Officer*

*Commissioner of Patents and Trademarks*